US007387157B2

(12) United States Patent
Gambier et al.

(10) Patent No.: US 7,387,157 B2
(45) Date of Patent: Jun. 17, 2008

(54) DYNAMIC INFLATABLE SEALING DEVICE

(75) Inventors: Philippe Gambier, Houston, TX (US); Jose F. Garcia, Sugar Land, TX (US); John Whitsitt, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 178 days.

(21) Appl. No.: 11/162,559

(22) Filed: Sep. 14, 2005

(65) Prior Publication Data

US 2007/0056749 A1 Mar. 15, 2007

(51) Int. Cl.
*E21B 33/127* (2006.01)

(52) U.S. Cl. ..... 166/187; 166/185

(58) Field of Classification Search ..... 166/185, 166/187, 387

See application file for complete search history.

(56) References Cited

U.S. PATENT DOCUMENTS

| | | | | |
|---|---|---|---|---|
| 2,922,478 | A * | 1/1960 | Maly | 166/154 |
| 2,942,667 | A * | 6/1960 | Bridwell et al. | 277/333 |
| 3,971,437 | A * | 7/1976 | Clay et al. | 166/187 |
| 4,424,860 | A | 1/1984 | McGill | |
| 5,400,855 | A * | 3/1995 | Stepp et al. | 166/151 |
| 5,549,165 | A * | 8/1996 | Brooks | 166/386 |
| 5,558,153 | A | 9/1996 | Holcombe | |
| 6,119,775 | A | 9/2000 | Drechsler | |
| 6,186,227 | B1 | 2/2001 | Vaynshteyn | |
| 6,289,994 | B1 | 9/2001 | Willauer | |
| 6,315,050 | B2 | 11/2001 | Vaynshteyn | |
| 6,352,119 | B1 | 3/2002 | Patel | |
| 6,564,876 | B2 | 5/2003 | Vaynshteyn | |
| 6,575,251 | B2 | 6/2003 | Watson | |
| 6,823,945 | B2 | 11/2004 | Eslinger | |

FOREIGN PATENT DOCUMENTS

| | | | |
|---|---|---|---|
| EP | 0275612 | A1 | 7/1988 |
| GB | 1441131 | A1 | 6/1976 |
| GB | 2076446 | A | 12/1981 |
| GB | 2322394 | A | 8/1998 |
| GB | 2362174 | A | 11/2001 |

* cited by examiner

*Primary Examiner*—Kenneth Thompson
(74) *Attorney, Agent, or Firm*—Henry L. Ehrlich; Bryan P. Galloway; Tim Curington

(57) ABSTRACT

A dynamic inflatable sealing device for maintaining the pressure within an inflatable element at least substantially equal to the pressure in the annulus to maintain the inflatable element in a sealing position. The dynamic sealing device includes an inflatable element forming an internal chamber, the inflatable element expandable to sealing engagement with a wall, and a dynamic valve mechanism in operational connection between the internal chamber and exterior of the internal chamber substantially communicating the pressure external of the inflatable element to the internal chamber.

7 Claims, 4 Drawing Sheets

DYNAMIC INFLATABLE SEALING DEVICE

FIELD OF THE INVENTION

The present invention relates in general to inflatable devices for providing a seal and in particular to hydraulically actuated packers.

BACKGROUND

Inflatable packers that comprise an elastomeric bladder are well known and are used in attempts to seal off sections of a wellbore. The bladder defines a chamber that contains a pressurized fluid which is used to inflate the packer while the elastomeric body seals against the wellbore and prohibits annular fluid flow past the packer when in the inflated position. Problems with inflatable packers include loss of the seal between the packer body and the wellbore. Factors that affect the reliability of the seal include pressure differentials, incomplete inflation, seal leaks and compressibility.

Therefore, it is a desire to provide a dynamic inflatable sealing device wherein the bladder is maintained at a pressure substantially equal to or greater than the pressure in the annulus between the packer body and the wall of the wellbore. It is a still further desire to provide a dynamic inflatable sealing device that maintains the bladder a pressure substantially equal to or greater than the highest annular pressure encountered. It is a still further desire to provide a dynamic inflatable sealing device that provides a full internal diameter passageway thus maintaining full fluid flow and the ability to pass equipment through the passageway.

SUMMARY OF THE INVENTION

In view of the foregoing and other considerations, the present invention relates to inflatable sealing devices and more particularly to an inflatable packer for subterranean wells.

Accordingly, a dynamic inflatable sealing device for maintaining the pressure within an inflatable element at least substantially equal to the pressure in the annulus to maintain the inflatable element in a sealing position is provided. An embodiment of the dynamic sealing device includes an inflatable element forming an internal chamber, the inflatable element expandable to sealing engagement with a wall, and a dynamic valve mechanism in operational connection between the internal chamber and exterior of the internal chamber substantially communicating the pressure external of the inflatable element to the internal chamber.

The dynamic valve mechanism may include a piston having a first piston head in communication with the exterior of the internal chamber and a second piston head in communication with the internal chamber, wherein the piston substantially communicates the pressure exterior of the internal chamber to the internal chamber. The first piston head may have a cross-sectional area greater than the cross-sectional area of the second piston head. The piston is positioned exterior of the passageway through the bladder thus maintaining the full internal diameter of the passageway.

A secondary energizing source may be in connection with the internal chamber for communicating a pressure to the internal chamber in addition to the pressure communicated from the region exterior of the internal chamber and inflatable element. The secondary energizing source may be in connection with the dynamic valve mechanism. The secondary energizing source may include, but is not limited to, a pressure chamber or biasing mechanism such as a spring.

An embodiment of an inflatable packer of the present invention includes a tubular body having an internal passageway, an inflatable element connected to the tubular body forming an internal chamber, the inflatable element expandable to sealing engagement with a wall. An annulus formed between the wall and the tubular body, the annulus having a first annular region and a second annular region separated by the sealing engagement. A first dynamic valve mechanism in operational connection between the internal chamber and the annulus, the first dynamic valve mechanism including a piston having a first piston head in communication with the first annular region and a second piston head in communication with the internal chamber.

An exemplary method for maintaining an inflatable element in a sealing position is provided. The method comprising the steps of disposing an inflatable member having an internal chamber in an annulus between an inner member and a wall, actuating the inflatable member to sealingly engage the wall, and communicating substantially the pressure in the annulus to the internal chamber.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1A:
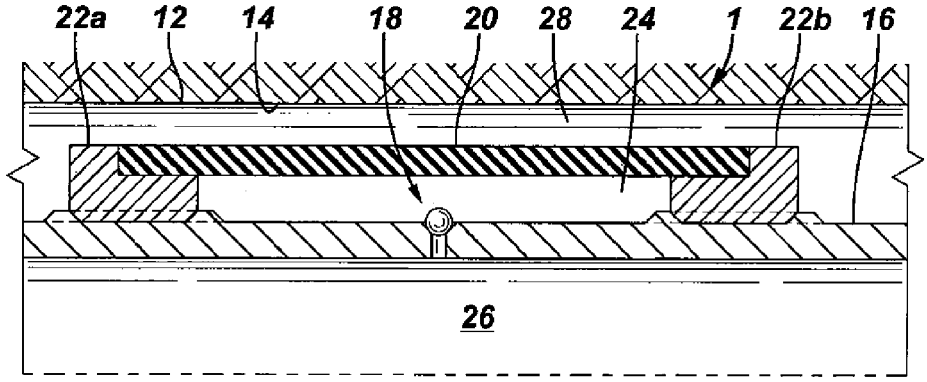
FIG. 1A (Prior Art)
FIG. 1A is a partial, cross-section view of a prior art inflatable packer, shown deflated for running into a wellbore.

Refer now to the drawings wherein depicted elements are not necessarily shown to scale and wherein like or similar elements are designated by the same reference numeral through the several views.

As used herein, the terms"up" and"down";"upper" and"lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a partial cross-section view of a prior art hydraulically actuated packer, generally referred to by the numeral 1. Packer 1 is shown positioned within a wellbore 12 having a wellbore wall or face 14. Packer 1 includes a tubular body 16, valve 18, inflatable element 20, and a housing 22.

Tubular body 16 is connected with a pipe string such as tubing string (not illustrated). As is well known in the art, tubular body 16 may be tubing, casing, a sub or other tubular element suitable for carrying a packer.

Inflatable element 20, generally referred to as a bladder, is an elastomeric member adapted to be actuated between a deflated position and an inflated or expanded sealing position. Bladder 20 is connected to tubing 16 by a housing 22 comprising a top packer head 22*a* and a bottom packer head 22*b*. Bladder 20 has an internal chamber 24 defined by the inflatable element 20, housing 22, and tubing 16.

A valve 18 is positioned in tubular body 16. Valve 18 provides fluid communication between the passageway 26 of tubular body 16 and internal chamber 24. Valve 18 is adapted to at least allow fluid to flow from passageway 26 into chamber 24, and may selectively allow flow between chamber 24 and passageway 26.

Figure 1B:
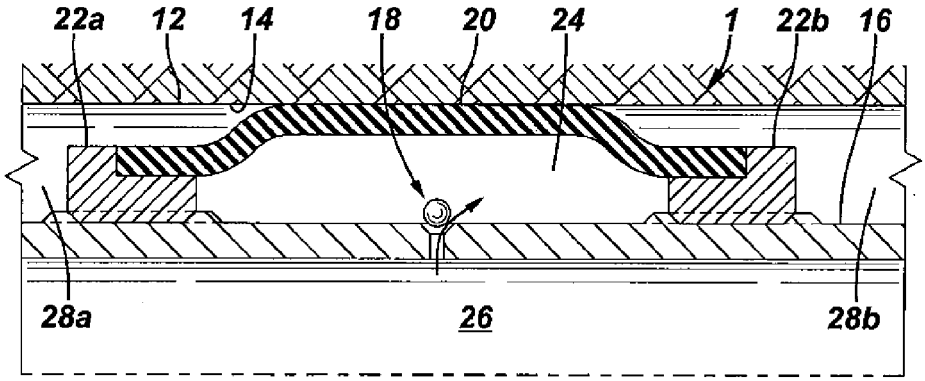
FIG. 1B (Prior Art)
FIG. 1B is a partial, cross-section view of a prior art inflatable packer, shown being actuated to seal against a wall of a wellbore.

FIG. 1B is a partial, cross-section view of the prior art inflatable packer 1 wherein the inflatable element 20 is being actuated to the sealing position. A fluid is pumped through passageway 26 and valve 18 into internal chamber 24. Inflatable element 20 expands outwardly from tubular body 16 until it is in sealing engagement with wall 14, dividing annulus 28 into a first annulus region 28*a* and a second annulus region 28*b*. The fluid utilized to actuate inflatable element 20 may be any suitable fluid such as, but not limited to, water, oil, gas, or gravel pack slurry.

Figure 1C:
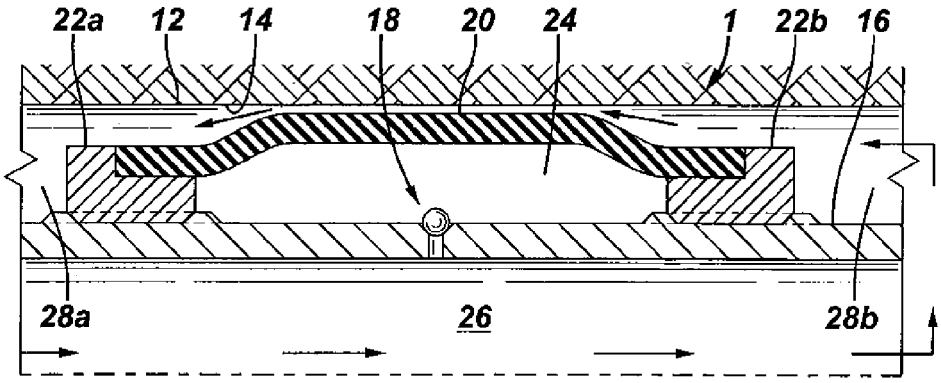
FIG. 1C (Prior Art)
FIG. 1C is a partial, cross-section view of a prior art inflatable packer, showing fluid flow past the inflated packer due to loss of the sealing engagement.

FIG. 1C is a partial, cross-section view of the prior art inflatable packer 1 wherein sealing engagement is lost when the pressure in second annular region 28*b* is greater than the pressure in internal chamber 24 and second annular region 28*b*. As shown, when the pressure in chamber 24 is less than the pressure in annulus 28, fluid may flow past the annulus seal provided by inflatable element 20 between annular regions 28*a* and 28*b*.

With reference to FIGS. 1A through 1C, a disadvantage of prior art inflatable sealing systems is illustrated. Inflatable packer 1, in the deflated position, is run into a wellbore 12 to a desired depth. A fluid is pumped into passageway 26 and through valve 18 into chamber 24. Inflatable element 20 is expanded outward from tubular body 16 into sealing engagement with wall 14. The seal is formed between wall 14 and tubular body 16 in annulus 28 separating a first annular region 28*a* from second annular region 28*b*. For purposes of illustration, annular region 28*a* is the annulus between the surface and inflatable packer 1 and second annular region 28*b* is the annulus below inflatable packer 1.

In FIG. 1C, a fluid is pumped through passageway 26, illustrated by arrows, and is injected into wellbore 12 and the surrounding formation below inflatable packer 1. In this example, the injected fluid is at a lower temperature than the ambient conditions, thus cooling the fluid in chamber 24. The colder injected fluid decreases the temperature of the fluid in chamber 24 decreasing the pressure in chamber 24. As a result, the sealing engagement between inflatable member 20 and wall 14 is broken and fluid, illustrated by the arrows, flows between annular regions 28*a* and 28*b*. This loss of sealing engagement between inflatable element 20 and wall 14 occurs in other situations in which the pressure in annulus 28 is greater than the maintained pressure in chamber 24.

Figure 2:
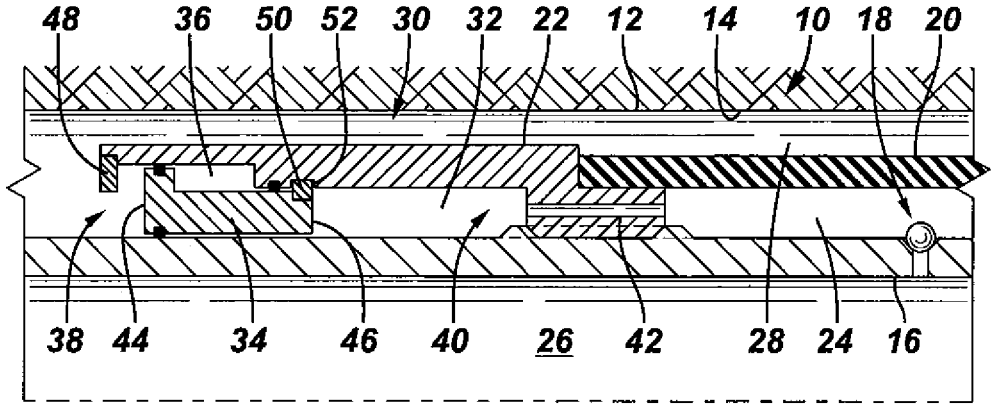
FIG. 2 is a partial, cross-section view of an embodiment a dynamic inflatable packer of the present invention in a static position.

FIG. 2 is a partial, cross-section view of an embodiment of a dynamic inflatable sealing device of the present invention, generally designated by the numeral 10. In the various embodiments and illustrated views of the present invention, inflatable sealing device 10 is illustrated as a packer utilized in a wellbore 12. Wellbore 12 is shown as an open hole having a wall 14. Wellbore 12 may be completed, wherein wall 14 may be casing or the like.

Dynamic packer 10 includes an inflatable element 20 and a dynamic valve mechanism 30. Inflatable element 20 is connected to a tubular body 16 via housing 22. Housing 22, may comprise a top packer head 22*a* and a bottom packer head 22*b* as shown in FIGS. 1A-1C. An inflatable element 20 forms a chamber 24 about a portion of tubular body 16.

A valve 18 is provided for introducing a fluid from passageway 26 of tubular body 16 into chamber 24 for actuating inflatable element 20. Valve 18 may be any suitable device for introducing fluid into chamber 24 including, but not limited to, gravel pack slurry as described in co-owned U.S. Pat. No. 6,575,251, which is incorporated herein by reference.

Dynamic valve mechanism 30 is in operational connection between annulus 28 and chamber 24 of inflatable element 24. Dynamic valve mechanism 30 maintains the pressure in chamber 24 substantially equal to or greater than the pressure in annulus 28. In the embodiment illustrated in FIGS. 2 through 5, dynamic valve mechanism 30 includes cylinder 32, piston 34, and a supplemental energizing mechanism 36. Supplemental energizing mechanism 36 is in operational connection with internal chamber 24 for applying a pressure, in addition to the pressure from annulus 28, to internal chamber 24. Supplemental energizing mechanism 36 biases piston 34 toward internal chamber 24. In this embodiment supplemental energizing mechanism 36 is a charged pressure chamber. Pressure chamber 36 may be maintained at atmospheric pressure, charged to a pressure greater than atmospheric pressure, and/or be connected to an additional pressure source, such as, but not limited to a surface supplied hydraulic pressure.

Cylinder 32 is formed in housing 22 and has a first end 38 open to annulus 28, and a second open end 40 in fluid communication with internal chamber 24. Second open end 40 of cylinder 32 may be connected to internal chamber 24 by a conduit 42.

Piston 34 is movably positioned within cylinder 32. Piston 34 has a first piston head 44 and a second piston head 46. First piston head 44 is oriented toward first open end 38 and annulus 28. First open end 38 has a stop 48, or a smaller cross-section than first piston head 38 to contain piston 34 within cylinder 32. Second piston head 48 is positioned toward internal chamber 24 and has a surface area less than that of second piston head 48.

Pressure chamber 36 may be formed between first piston head 44 and second piston head 46. Pressure chamber 36, may be filled with a fluid, such as, but not limited to, nitrogen. As illustrated through the various embodiments, supplemental energizing mechanism 36 provides a force in addition to the pressure in annulus 28 on piston 34. These forces acting on piston 34 biases piston 34 to maintain pressure in chamber 24 and on inflatable element 20.

Desirably, dynamic valve mechanism 30 further includes a lock 50 adapted to hold piston 34 in an initial, or static, position when running inflatable packer 10 into wellbore 12. Lock 50 is illustrated as a C-ring disposed within a detent 52 formed by housing 22 in cylinder 32.

FIG. 2 illustrates dynamic valve mechanism 30 in the static position as inflatable packer 10 is being run into wellbore 12. The pressure in annulus 28 is acting on first piston head 44, urging piston 34 toward second open end 40 of cylinder 32. The pressure in internal chamber 24, which may be equal to the tubing pressure (the pressure in passageway 26) is acting on second piston head 46, urging piston 34 toward first open end 38. Due to the larger cross-section of first piston head 44 than second piston head 46, piston 34 is being urged toward second open end 40. However, inflatable member 24 remains deflated, and piston 34 is held in a static position relative to cylinder 32 by lock 50 positioned in detent 50 and against piston 34.

Figure 3:
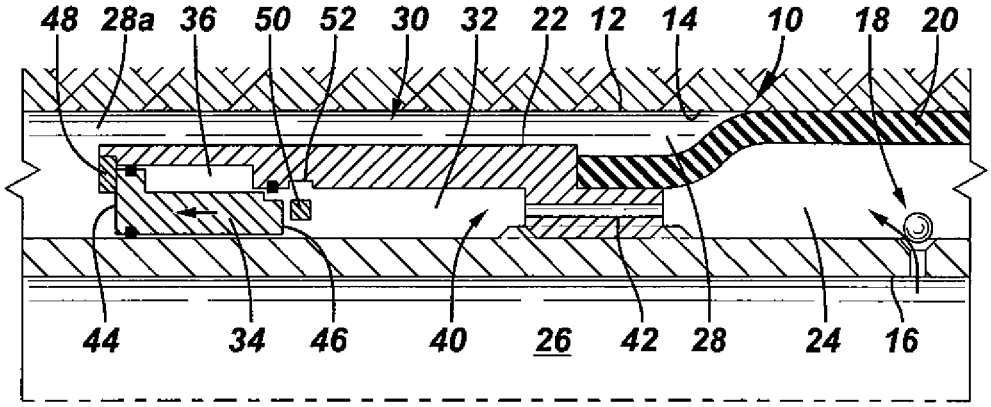
FIG. 3 is a partial, cross-section view of the inflatable packer of FIG. 2, wherein the inflatable element is being actuated to the sealing position.

FIG. 3 is a partial, cross-section view of the inflatable packer 10 of FIG. 2, wherein inflatable element 20 is being actuated to the sealing position. Inflatable packer 10 is disposed in the desired position within wellbore 12. Fluid is pumped through passageway 26 and valve 18 into chamber 24 expanding inflatable element 20 into sealing engagement with wall 14. Inflatable element 20 seals annulus 28 between tubular body 16 and wall 14.

When inflatable element 20 is being actuated the fluid pressure in chamber 24 is greater than the pressure in annulus 28, more specifically annular region 28*a* in FIG. 3. Thus, the fluid pressure in chamber 24 acting on second piston head 46 is greater than the force urging piston 34 toward second open end 40 causing piston 34 to move toward stop 48 as shown by the arrow. When piston 34 moves a sufficient distance, lock 50 is released, freeing piston 34 for movement in cylinder 32. Dynamic valve mechanism 30 is now in the dynamic position.

In the dynamic position, when pressure in internal chamber 24 is greater than the pressure in annulus 28 plus the pressure provided by supplemental energizing mechanism 36, piston 34 is limited in movement by stop 48. When the pressure in annulus 28 plus the pressure provided by supplemental energizing mechanism 36 is greater than the pressure in internal chamber 24, piston 24 is urged toward second open end 40 thus increasing the pressure in internal chamber 24. In effect, dynamic valve mechanism 30 maintains a minimal pressure in internal chamber 24 substantially equal to the pressure in annulus 28 plus the pressure provided by supplemental energizing mechanism 36, thereby maintaining inflatable element 20 in sealing engagement with wall 14.

Figure 4:
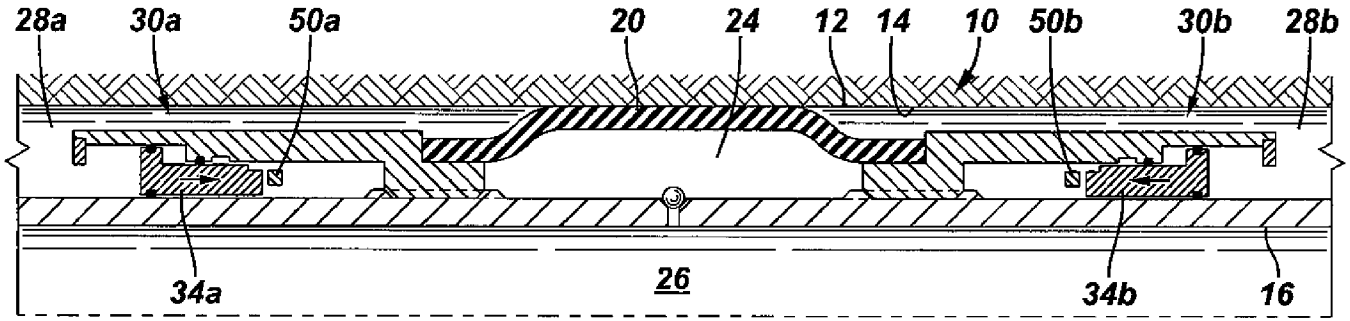
FIG. 4 is a partial, cross-section view of an embodiment of the dynamic inflatable packer of the present invention having two dynamic valve mechanisms.

FIG. 4 is a partial, cross-section view of an embodiment of the dynamic inflatable packer of the present invention having two dynamic valve mechanisms 30*a*, 30*b*. Inflatable element 20 is shown actuated and in sealing engagement with wall 14, separating a first annular region 28*a* from a second annular region 28*b*. Dynamic inflatable packer 10 includes a first dynamic valve mechanism 30*a* in fluid and pressure communication with first annular region 28*a* through first open end 38*a* of dynamic valve mechanism 30*a*. A second dynamic valve mechanism 30*b* is in fluid and pressure communication with second annular region 28*b* through first open end 38*b* of dynamic valve mechanism 30*b*. In the dual dynamic valve mechanism embodiment, chamber 24 is maintained at a pressure at least substantially equal to the highest pressure encountered in annulus 28, either annular region 28*a* or 28*b*.

As shown in FIG. 4, the pressure in annular region 28*a* and annular region 28*b* is substantially equal. Thus, both pistons 34*a* and 34*b* are urged toward chamber 24 as shown by the arrows.

Figure 5:
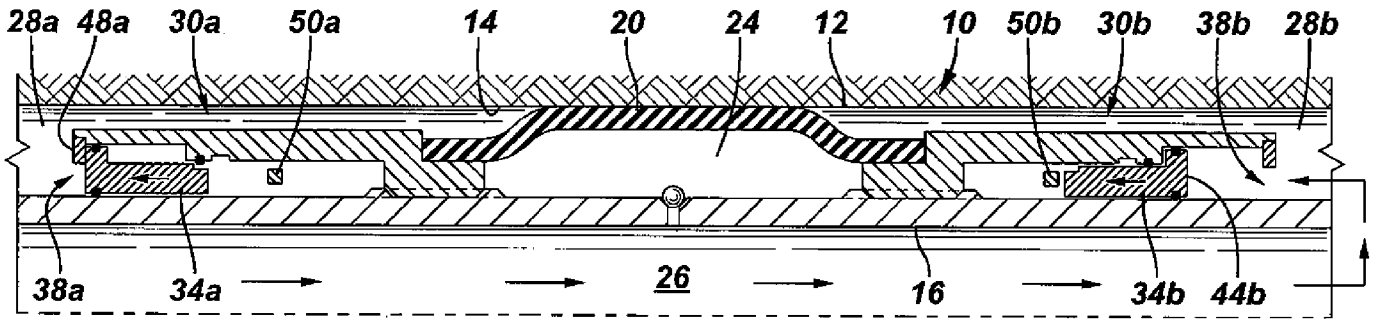
FIG. 5 is another partial, cross-section view of a dual dynamic valve mechanism embodiment of the present invention.

FIG. 5 is a partial, cross-section view of an embodiment of dynamic inflatable packer 10 of the present invention wherein the pressure in annular region 28*b* is greater than the pressure in annular region 28*a*. As in FIG. 1C, fluid is being injected into the formation surrounding wellbore 12, illustrated by the arrows. The pressure in annular region 28*b* is greater than the pressure in annular region 28*a*. Unlike in the prior art system illustrated in FIG. 1C, the pressure in internal chamber 24 is maintained substantially at or greater than the highest annular pressure maintaining inflatable element 20 in sealing engagement with wall 14.

The greater pressure in annular region 28*b* acts on first piston head 44*b* of piston 34*b*, urging piston 34*b* to communicate pressure to internal chamber 24. As piston 34*b* is moved toward internal chamber 24 the pressure in annular region 28*b* acts on inflatable element 20 and the opposing dynamic valve mechanism 30*a*. Piston 34*a* of dynamic valve mechanism 30*a* moves away from internal chamber 24 until either (i) the pressure in annular region 28*a* acting on piston 34*a* and the pressure in annular region 28*b* equalize, or (ii) travel of piston 34*a* is halted at stop 48*a*.

Figure 6:
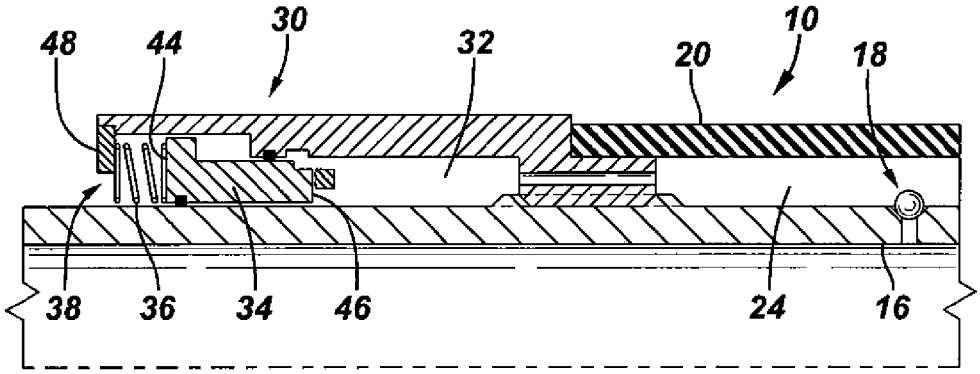
FIG. 6 is a partial, cross-section view of another embodiment of the dynamic inflatable sealing device of the present invention.

FIG. 6 is a partial, cross-section view of another embodiment of dynamic inflatable sealing device 10 of the present invention. In this embodiment, the supplemental energizing mechanism 36 comprises a spring. Spring 46 is positioned between first piston head 44 and the first open end 38 of cylinder 32. As with other embodiments of the present invention, supplemental energizing mechanism 36 provides a means of maintaining a pressure in internal chamber 24 greater than the pressure in the annulus.

Figure 7:
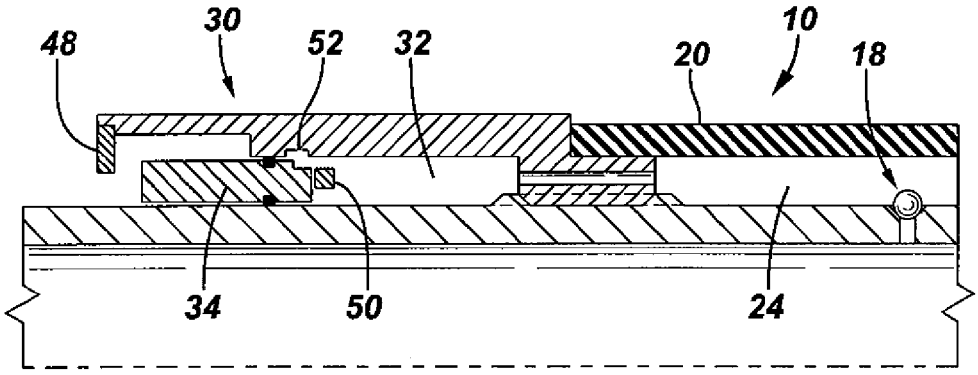
FIG. 7 is a partial, cross-section view of a further embodiment of the dynamic inflatable sealing device of the present invention.

FIG. 7 is a partial, cross-section view of another embodiment of dynamic inflatable sealing device 10 of the present invention. In this embodiment, piston 34 is a shuttle valve and dynamic valve mechanism 30 does not include a supplemental energizing mechanism 36. The pressure in internal chamber 24 is maintained substantially equal to the pressure exterior of inflatable element 20.

From the foregoing detailed description of specific embodiments of the invention, it should be apparent that a dynamic packer for maintaining the packer in sealing engagement with the wall of the wellbore or outer pipe string that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. An inflatable sealing device, the device comprising:

an inflatable element forming an internal chamber, the inflatable element expandable to sealing engagement with a wall; and a dynamic valve mechanism in operational connection between the internal chamber and exterior of the internal chamber; wherein the dynamic valve mechanism maintains the pressure in the internal chamber substantially equal to or greater than the pressure external of the inflatable element after the inflatable element is expanded and in sealing engagement with the wall; the dynamic valve mechanism comprising:

a piston having a first piston head in communication with the exterior of the internal chamber and a second piston head in communication with the internal chamber, wherein the piston substantially communicates the pressure exterior of the internal chamber to the internal chamber; and a supplemental energizing mechanism in operational connection with the internal chamber for communicating a pressure into the internal chamber; the supplemental energizing mechanism including a biasing mechanism connected to the piston.

2. The device of claim 1, further including:

an inner member, wherein the inflatable element is connected to the inner member and the internal chamber is formed between the inflatable member and the inner member; and a passageway formed through the inner member for flowing fluid past the inflatable element.

3. The device of claim 2, wherein the exterior of the internal chamber is an annulus between the wall and the inner member; and the dynamic valve mechanism is positioned exterior of the passageway.

4. The device of claim 1, wherein the first piston head has a cross-sectional area greater than the cross-sectional area of the second piston head.

5. The device of claim 1, wherein the biasing mechanism comprises a pressure chamber acting in fluid connection with the piston.

6. The device of claim 1, further including a lock in releasable connection with the piston, wherein when the lock is engaged with the piston, the piston is held in a static position and when the lock is disengaged from the piston, the piston is free to move and to affect the pressure in the internal chamber.

7. The device of claim 1, further including:

a second dynamic valve mechanism in operational connection between the internal chamber and a region exterior of the internal chamber, the region separated by the sealing engagement of the inflatable element with the wall from the exterior of the internal chamber in fluid communication with the other dynamic valve mechanism.

* * * * *